United States Patent [19]

Triulzi

[11] 4,106,443

[45] Aug. 15, 1978

[54] ROTARY INTERNAL COMBUSTION ENGINE

[76] Inventor: Joseph P. Triulzi, 5931 Abernathy Dr., Los Angeles, Calif. 90045

[21] Appl. No.: 731,519

[22] Filed: Oct. 12, 1976

[51] Int. Cl.[2] ..... F02B 57/00

[52] U.S. Cl. ..... 123/43 R; 123/44 R; 92/54; 417/462

[58] Field of Search ..... 123/43 R, 43 C, 44 R, 123/44 C, 44 D, 44 E; 92/54; 417/462

[56] References Cited

U.S. PATENT DOCUMENTS

| | | | |
|---|---|---|---|
| 1,108,152 | 8/1914 | Edquist | 123/43 R |
| 1,108,980 | 9/1914 | Edquist | 123/43 R |
| 1,216,160 | 2/1917 | Paige | 123/43 R |
| 1,576,392 | 3/1926 | Williams | 123/43 R |
| 2,126,093 | 8/1938 | Curtis | 123/43 C |
| 2,886,017 | 5/1959 | Dib | 123/43 R |
| 2,889,783 | 6/1959 | Woydt | 123/44 R |
| 3,270,723 | 9/1966 | Maroney | 123/43 R |
| 3,688,751 | 9/1972 | Sahagian | 123/44 E |
| 3,931,809 | 1/1976 | Corte | 123/43 R |

*Primary Examiner*—Clarence R. Gordon

*Attorney, Agent, or Firm*—Henry M. Bissell

[57] ABSTRACT

A rotary internal combustion engine is described and shown having two piston and cylinder assemblies rotating about a single axis. The pistons reciprocate in rotating cylinders having a four cycle internal combustion engine process to receive air and fuel, to compress the air and fuel, to combust the mixture and to exhaust the gases therefrom. The pistons move in a set relation to each other, being connected by a common rod. The center of rotation of the pistons is dynamic relative to the center of rotation of the cylinders and cylinder blocks. Intake and exhaust valves are positioned about the periphery of the rotor assembly, and have staggered opening and closing schedules in order that air and fuel may be admitted and gases scavenged in accordance with the four cycle internal combustion engine principle. Rotating valve members having diametrical passages are rotated by a common drive, but positioned relative to each other so that their openings sequentially open and close to coordinate with the rotating rotor assembly. Alternative embodiments for use as a compressor are described.

24 Claims, 10 Drawing Figures

ROTARY INTERNAL COMBUSTION ENGINE

BACKGROUND OF THE INVENTION

1. Field of the Invention

This invention relates to rotary internal combustion engines, and in particular four cycle, rotary internal combustion engines.

2. Description of the Prior Art.

The internal combustion engine (ICE) is the conventional power source for motor vehicles and many other forms of rotary power in the world today. Traditionally, pistons reciprocating in corresponding cylinders are used to rotate an output shaft which through transmission coupling is used to rotate a drive shaft in the vehicle. In the conventional four cycle internal combustion engine, a piston is moved within the cylinder to create an expanding chamber into which air and fuel are inserted or drawn. The piston in its second stroke is moved within the cylinder to compress the chamber as the air and fuel drawn in the first stroke are prevented by a valve mechanism from escaping from the chamber. In the third or power stroke, the piston is driven by the combustion of the air and fuel within the now compressed chamber, thus expanding the chamber. The fourth stroke is known as the exhaust stroke, wherein the piston compresses the chamber and by valve mechanisms the combusted air and fuel is allowed to escape. The four strokes are repeated for the continued driving of the piston. The piston can be connected by linkage to a rotating shaft from which rotary shaft power may be obtained.

It has in several instances in the past been proposed to arranged the cyclinders and pistons so that they essentially rotate about an axis of rotation along which the output shaft lies. Because of industrial pressures for efficiency and power production, many have been led to design rotary ICE power plants of varying shapes and designs for particular applications. In most such rotary ICEs, a true circular interior is not designed in order that power may be achieved from a not precisely circular rotation. Others have designed a stationary shaft about which a rotary housing or block revolves. At least one other has designed an off center rotation of cylinders where the pistons are frictionally engaged with the circular housing, to create a movement of the pistons through the cylinders in the conventional four cycle fashion.

All of these rotary ICE designs so far as is known have met with varying degrees of success according to the objects and problems they were designed to solve. Nonetheless, it is still desired to construct an efficient rotary internal combustion engine having the simplest manufactured structural elements with a minimum of friction between the moving parts during the rotation.

SUMMARY OF THE INVENTION

In accordance with the preferred aspect of the invention, a rotary internal combustion engine is described having a cylindrical interior surface within which a rotor assembly rotates. The rotor assembly comprises cylinders disposed having pistons reciprocating therein. The cylinders rotate about the center axis of the interior cylindrical surface. An output shaft is positioned along the center axis and is driven by virtue of its connection with the cylinders within the rotor assembly.

The pistons are by linkage connected to each other through a rotating connecting rod. The connecting rod rotates within the interior cylindrical surface about a dynamic axis which is defined by a mechanical linkage between the connecting rod and a yoke anchored to the housing within which the interior cylindrical surface is positioned.

Air and fuel are admitted into the cylinders through a plurality of valve openings within the housing cylinder and the interior cylindrical surface. The valves are operated by a planetary gear control so that each valve is selectively opened for the moment during the appropriate stroke when the cylinder rotates into juxtaposition along the interior cylindrical surface with the particular valve.

The sequential valve opening and the movement of the pistons within the cylinders are coordinated to operate on the principle of the four cycle ICE. The movement of the center of rotation of the connecting rod through a path relative to the rotor assembly center of rotation, moves the pistons within the cylinder even as both the pistons and the cylinders rotate about the rotor assembly axis. Air and fuel are inserted into the cylinders in the appropriate cycle strokes allowing combustion to occur, and allowing propulsion of the rotor assembly in its rotary motion.

Alternative embodiments envision the use of the structure as a two cycle compressor or compressor pump. Gas or liquid intakes through valves during one-half of a cylinder revolution and exhausts or is expelled during the remaining half. Power is transmitted from a suitable rotary power source, such as an electric motor, to a rotor assembly axle to which the cylinders are attached. The gas may be compressed by delaying exhaust in the compression or exhaust stroke.

BRIEF DESCRIPTION OF THE DRAWING

A better understanding of the present invention may be had from a consideration of the following detailed description taken in conjunction with the accompanying drawings, in which.

DESCRIPTION OF THE PREFERRED EMBODIMENT

Figure 1:
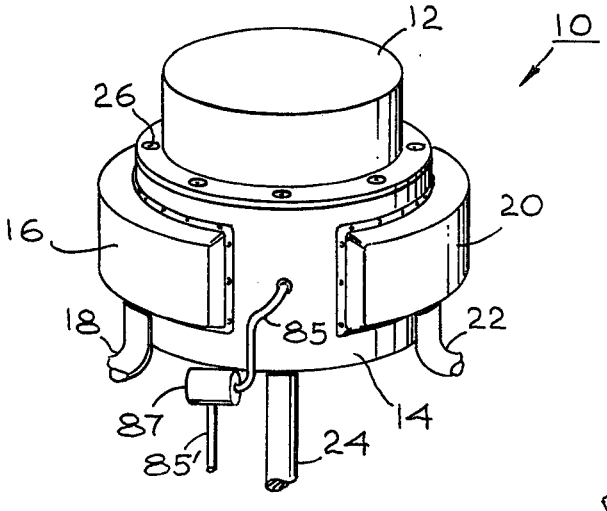
FIG. 1 illustrates a perspective view of the rotary engine housing and cover assembly.

In FIG. 1 of the drawings, the rotary internal combustion engine 10 is seen in perspective view having an assembly cover 12 covering the working parts. The engine includes a housing 14, intake manifold 16 and exhaust manifold 20. An intake pipe 18 feeds air to the intake manifold 16 in the conventional manner. Exhaust manifold 20 channels the exhaust gases into exhaust pipe 22 which may lead to the exterior of the vehicle, not shown. Fuel injector 87 may inject fuel from line 85' to the combustion chambers through line 85, which will be described in greater detail below.

Output shaft 24 is fixed to the rotor assembly, explained in greater detail below. The assembly cover 12 is fastened to the housing 14 by bolts 26. The cover 12 may be removed for repair and overhauling of the engine, as will be appreciated from the description that follows.

Figure 2:
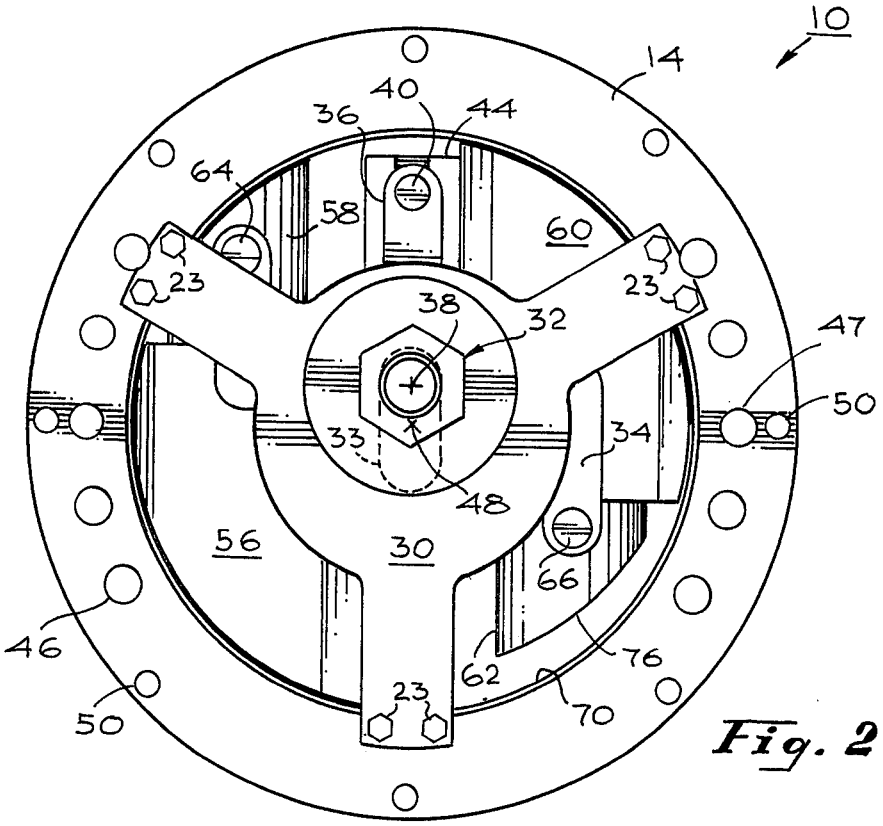
FIG. 2 is a top view of the interior of the preferred embodiment of the invention, having the cover removed.

FIG. 2 illustrates the view of the engine 10 having the cover 12 removed. A yoke 30 consists of a spider-like support structure of radially extending arms attached to the housing 14. Locking mechanism 32 in slot 33 secures connecting rod 34 movably to the yoke 30 through a crank 36. The operation of the locking mechanism and of the connecting rod 34 will be explained in greater detail below.

Figure 3:
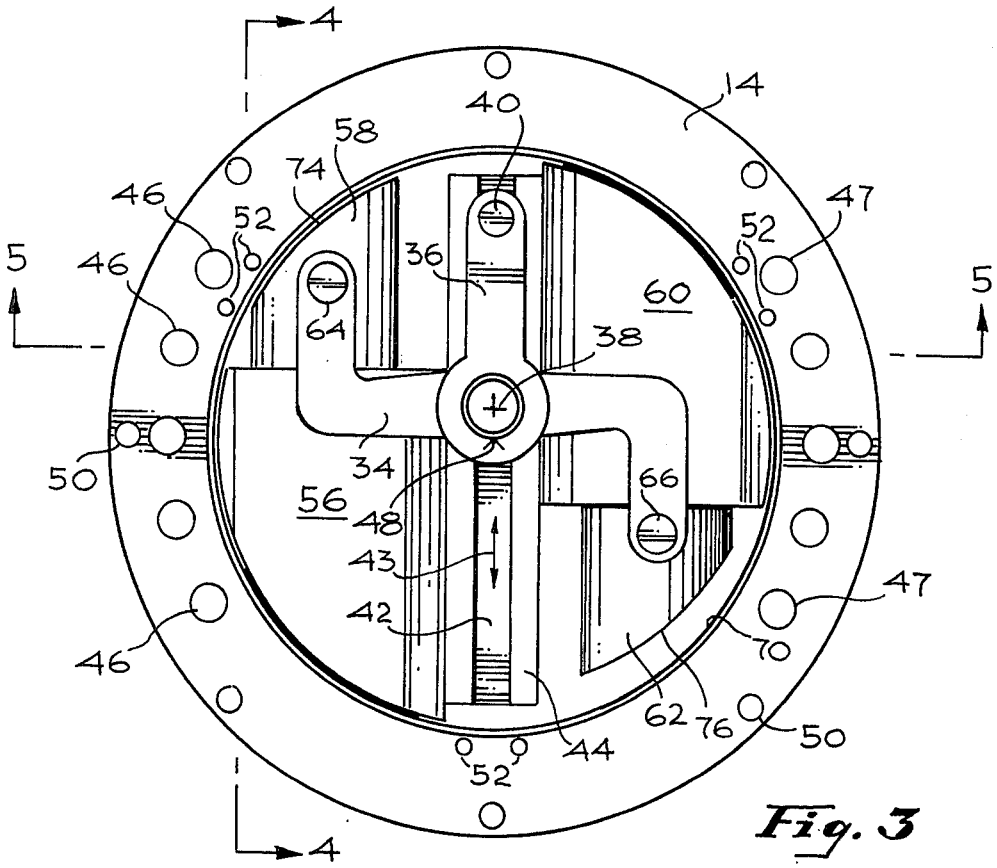
FIG. 3 is a top view of the interior of the rotary engine having certain elements removed.
Figure 4:
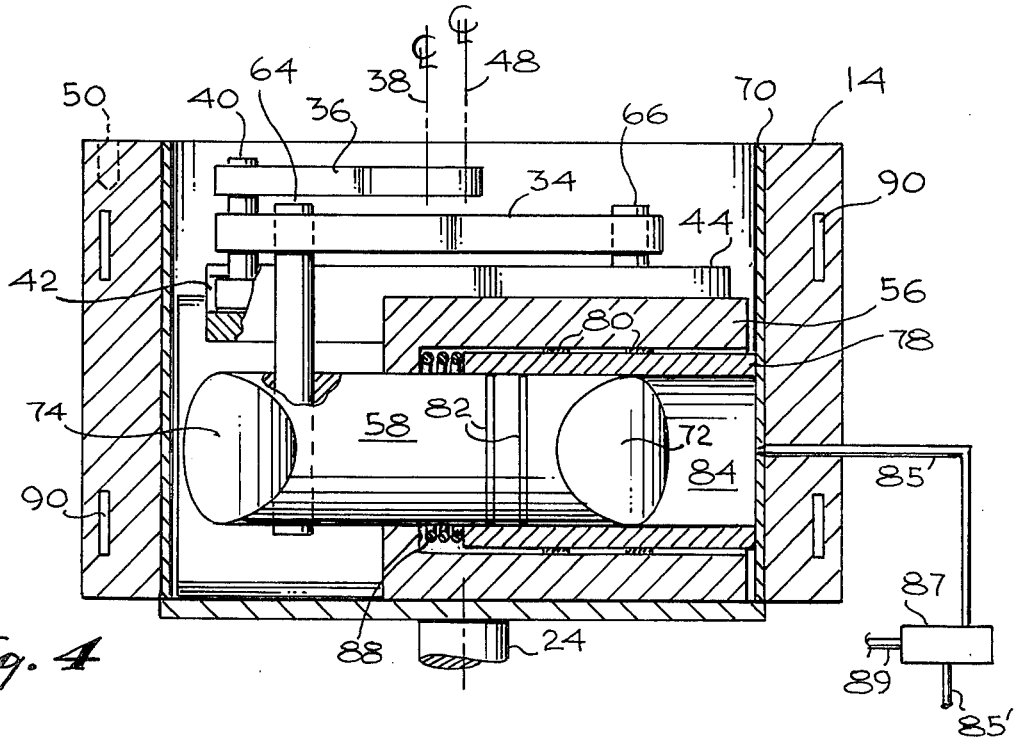
FIG. 4 illustrates a cross-sectional elevation view of the invention as seen from line 4—4 of FIG. 3.
Figure 5:
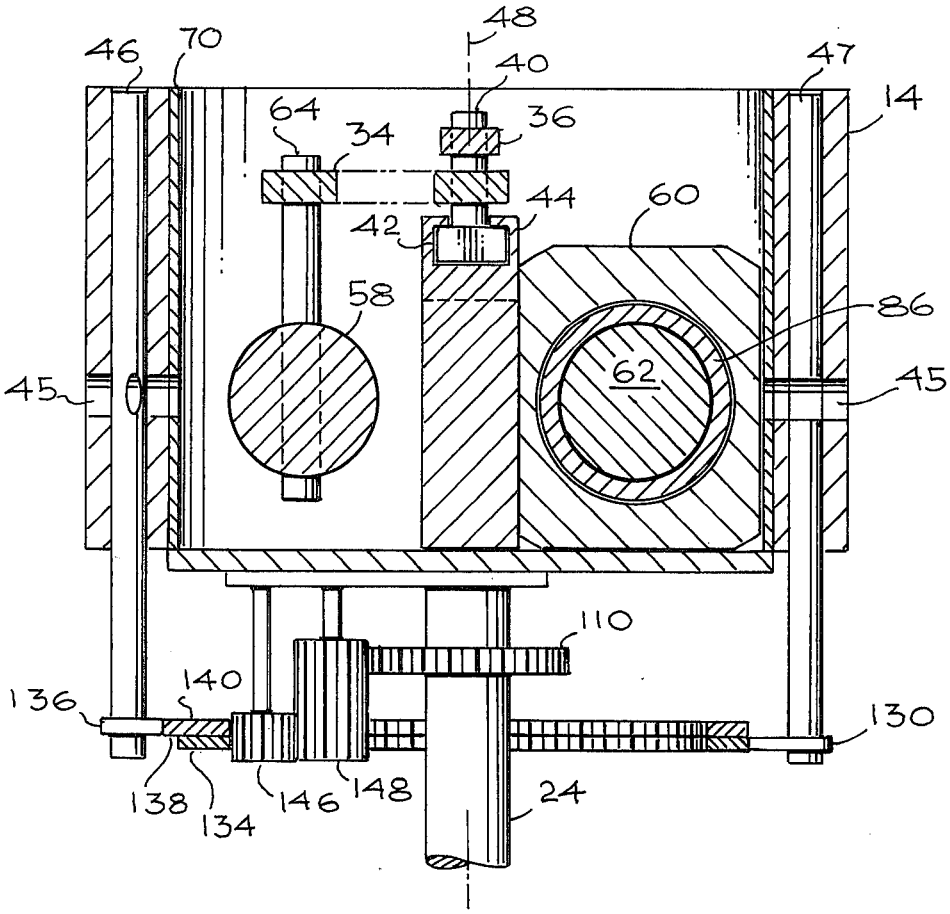
FIG. 5 represents a cross-sectional elevation view of the invention as seen from line 5—5 of FIG. 3 showing details of the cam operation.

Referring now to FIGS. 3, 4 and 5, the internal elements of the rotor assembly are shown in greater detail. The yoke 30 has been removed from the top view of FIG. 3, revealing the crank 36. Crank 36 rotates about axis 38 and is rotatably secured by the locking mechanism 32 to the yoke 30. In such a manner, the crank 36 is rotatably anchored to the housing 14. Crank 36 at its second end is slidably mounted by link pin 40 to the track or guideway 42 in guide 44. The locking mechanism 32 is tightened within slot 33 in order that the rotation axis 38 of the crank 36 remains constant. Nonetheless, the locking mechanism can be adjusted along the slot 33. In such a manner, the path of the rotation axis 38 can be modified.

Link pin 40 connects the greater radius rotating end of crank 36 to the rod 34. Guide 44 rotates about axis 48 which is parallel to but distinct from axis 38. Axis 48 constitues the center of rotation for the rotor assembly, as will become apparent. As the guide 44 rotates about axis 48, crank 36 rotates about its axis 38. The link pin 40 slides in guideway or track 42 in the direction of the arrows 43.

In housing 14, intake valves 46 are provided on the left side of the view as shown in FIG. 3. Exhaust valves 47 are positioned symmetrically about a diameter of the housing of FIG. 3. Bolt holes 50 provide a means for securing the cover 12 to the housing 14. The yoke 30 is secured to the housing 14 by bolts anchored in bolt holes 52.

Cylinder block 56 has a piston 58 movable longitudinally along the axis of the cylinder within the cylinder block 56. Positioned opposite the guide 44 is cylinder block 60 having piston 62 movable longitudinally along the axis of the cylinder within cylinder block 60. The movement of piston 58 is governed by connecting rod 34 by virtue of the connection between the rod 34 and the piston 58 provided by piston pin 64. Similarly, the movement of piston 62 is determined by rod 34 through the movement of piston pin 66 linking connecting rod 34 with piston 62. In such a manner, the positions of link pin 40 and pistons 58 and 64 are determined relative to each other as the rod 34 revolves around its own independent axis 38.

The pistons 58 and 62 are shaped at both their longitudinal ends to fit within an interior surface 70. As best seen in FIG. 4, piston 58 has faces 72 and 74 at its longitudinal ends. Similarly, piston 62 has curved face 76. The cylinder blocks 56 and 60 similarly are shaped at their ends and along their sides in a curved manner so that they may fit conforming to the interior cylindrical surface 70.

The piston within cylinder block 56 is seen in FIG. 4. Piston 58 is machined to fit within a cylinder sleeve 78. Pressure seals 80 maintain a seal between the sleeve 78 and the block 56. Oil and gas piston rings 82 are placed on the piston 58 so that a selectively airtight combustion chamber 84 may be defined within the cylinder. Cylinder block 60 has a similar sleeve 86 defining a similar chamber 84. Fuel injection line 85 opens through a nozzle into the combustion chamber 84, as will be explained in greater detail below. The fuel is received from fuel injector 87 (FIG. 4) actuated by cams 132, 138 (FIGS. 5 and 6) through rod 89 and rod lever 89'. Fuel can be received in the injector 87 in line 85' after filtration and pumping in the conventional manner.

The cylinder blocks 56, 60 are machined so that they do not frictionally engage the interior cylindrical surface 70. Sleeves 78, 86 do engage the interior cylindrical surface 70, sealing the cylinders. Spring 88 is used to bias sleeve 78 to provide an airtight cylinder chamber 84. A similarly placed spring, not shown, is used to bias sleeve 86. When the cylinder blocks 56, 60 are rotating about axis 48, the sleeves 78, 86 will be biased by centrifugal force into engagement with the interior surface 70, providing greater assurance of airtight cylinders during operation.

The lining of the housing 14 with the interior cylindrical surface 70 allows for simpler manufacturing of the housing 14. The interior surface against which friction will be experienced can be made with a more precisely machinable hard metal or the like. The housing 14, then, may be made by casting aluminum or by other methods which will be well known to those skilled in the art. The housing 14 may be water cooled by a water jacket 90 or by air cooling ports, both methods being well known.

Figure 6:
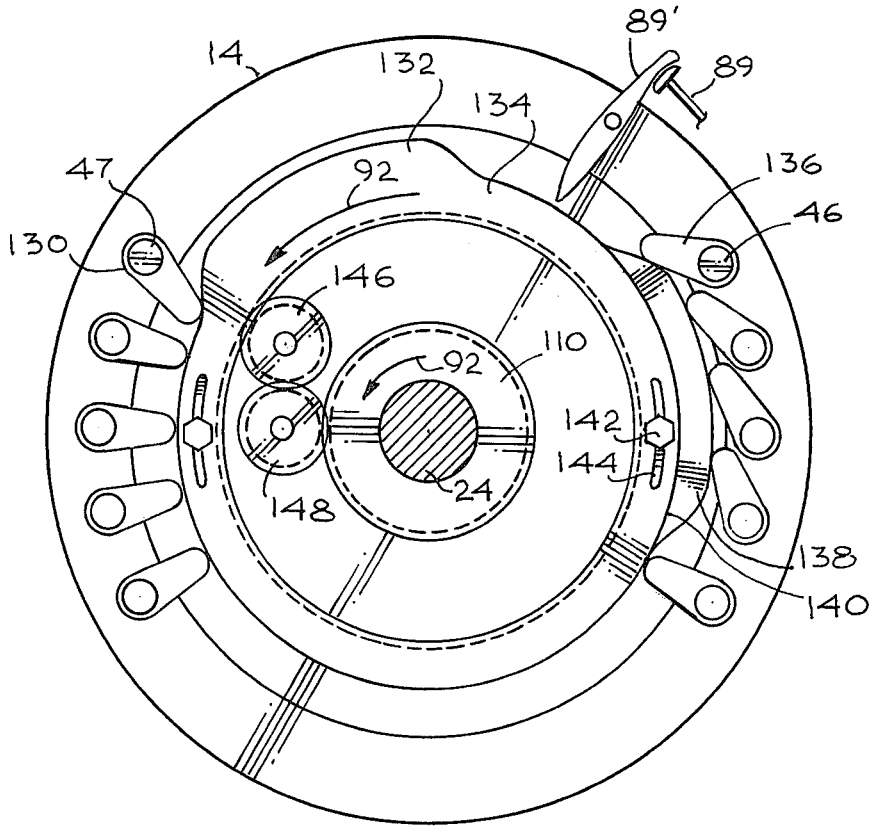
FIG. 6 is a bottom view of the housing showing a valve actuating mechanism.
Figure 7:
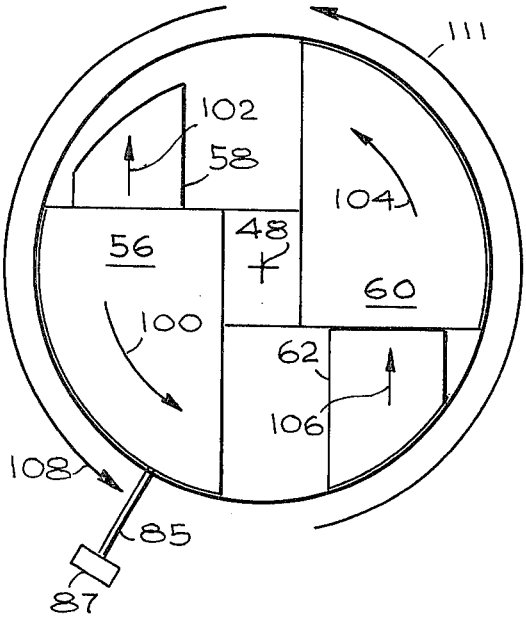
FIGS. 7 and 8 illustrate schematic views of the engine during progressive cycles of operation.

Referring now to FIGS. 5 and 6, operation of the valve mechanism is shown. A cross-sectional view of the housing 14 is shown taken through two valves 46 and 47. The valves 46 and 47 rotate first in a clockwise direction as seen in FIG. 7. The valves are caused to rotate by a unitary control, so that when the chamber 84 is juxtaposed in the exhaust stroke opposite the corresponding passages through the housing 14, the valve is opened to allow gas to pass from chamber 84 to the exterior of the housing 14 through port 45.

The same half of the engine housing 14 used for the exhaust stroke is also used for the compression stroke. Thus, when the cylinder is in its compression stroke, it is necessary to have the passageway through housing 14 closed. During the exhaust stroke, however, it is necessary that the valves 47 be opened to allow the gases to exhaust. The valves 47 are, therefore, sequentially rotated so that they will be open coincidentally with the passage of chamber 84 adjacent their corresponding passageways during the exhaust stroke of the cylinder block 60.

In FIG. 6, the cylinder blocks are progressing in the counterclockwise direction as indicated by the arrow 92. As chamber 84 passes adjacent valve 46, the passage in valve 46 is opened to allow intake of air. Sequentially, successive valves 46 are rotating in the clockwise direction and are opened to begin allowing air to intake into chamber 84. As cylinder block 60 progresses in the counterclockwise direction, valves 46 will become more open as they rotate in the clockwise direction. Trailing valves 46, on the other hand, rotate to close their passages. Valves 46 will progressively rotate in a clockwise direction so as to open the passageways through the valves and housing 14 when chamber 84 progresses to a position adjacent these valve openings. The valves rotate to their closed mode after the chamber 84 has progressed beyond them.

The valves are opened and closed by cam plates rotatably held by rim plates, not shown, in the axle end of the housing 14. The lower end of the valve members 47 are connected to cams 130 which are engaged by the cam 132 of cam plate 134. Similarly, cams 136 are connected to the lower end of intake valves 46, and are adapted to be engaged by the cam 138 of cam plate 140. Cam plate 140 is adjustable relative to cam plate 134 by loosening of the slide screws 142 in slide tracks 144. The cam plates 134, 140 have their interior circumferences shaped to engage central planetary gear 146. Drive shaft 24 is shaped to form a sun gear 110 driving planetary gear 148, which in turn drives the planetary gear 146. The cams 134, 140 thus rotate in the same direction as the drive shaft 24.

Because the cylinder receives air only on every second revolution, it is important that the intake valves be opened or rotated only every second revolution of the drive shaft 24. Similarly, the exhaust valves should be opened only every second revolution of the drive shaft 24. Consequently, the radius of the central gear 110 on the drive shaft must be one-half of the radius of the interior circumference of the cam plates 134, 140, assuming that the axes of the planetary gears 146, 148, remain stationary relative to the axis of the shaft 24. Varying sizes of the planetary gear and movement of the planetary gear about the sun gear 110 on shaft 24 can be arranged, so long as the rotation of the cam plates 134, 140 remain one-half that of the drive shaft 24. Other alternative arrangements, such as one-way valves or valve lifting arrangements may be used instead of rotary valves as shown.

The rotary internal combustion engine operates generally as follows. The rotor assembly, comprising the cylinder blocks 56 and 60 and the guide 44, rotates about the assembly axis 48. The crank 36 rotates about a distinct axis 38, preselected by positioning the locking mechanism 32 within the slot 33 of the yoke 30. In rotation, the guideway 42 rotates in a clockwise direction as seen in FIGS. 2 and 3. Link pin 40 connects the rotating end of crank 36 and the connecting rod 34, and is constrained within guideway 42. The pistons 58 and 62 are connected by corresponding pins 64 and 66 to rod 34. Link pin 40 moves as indicated by arrow 43, within the guideway 42 a short distance to and from the axis 48. The movement of link pin 40 has a longitudinal component along the guideway 42 and a circular component about axis 38 by virtue of the constraint of the rotating end of crank 36. The pistons 58 and 62 and the rod 34, consequently, rotate about a dynamic axis within the constraints of their corresponding blocks 56 and 60.

Simultaneously, the cylinder blocks 56, 60 are caused to rotate along with the guide 44 in the clockwise direction about the axis 48. As will now be appreciated, the pistons 58, 62 have a rotary motion about axis 48, as well as a longitudinal motion parallel to guideway 42. The pistons 58 and 62 have a rotation whose center or axis is dynamic and varies in a circular pattern including in its traverse the axes 38 and 48. The effect of the piston movement caused by this motion is to cause the combustion chambers, such as combustion chamber 84 (FIG. 4) to compress and expand once during a complete 360° movement of the cylinder blocks 56, 60 about axis 48. Thus in order to accomplish the complete four strokes of the engine cycle, it is necessary for the cylinder blocks 56, 60 to complete two revolutions about axis 48.

Figure 8:
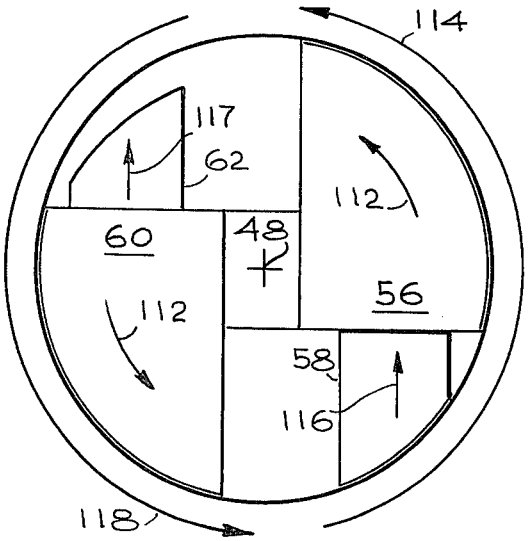

In FIGS. 7 and 8, a schematic diagram shows the progression of the rotor assembly about axis 48 through the four strokes of the internal combustion engine cycle described. In these diagrams, the engine is considered as viewed from the bottom, intake valves on the right, exhaust valves on the left. The arrows 108, 111, 114 and 118 correspond respectively to the compression, intake, power and exhaust strokes of the four-stroke cycle and relate roughly to the travel of the leading portion of a cylinder block 56 or 60. In FIG. 7, cylinder block 56 is moving in the counterclockwise direction as indicated by the arrow 100. Piston 58 will begin its movement in the direction of arrow 102. Simultaneously, cylinder block 60 will continue its movement as indicated by arrow 104. Its corresponding piston 62 will commence its movement in the direction indicated by arrow 106. The exhaust valves will be closed and the combustion chamber within cylinder block 60 will be compressed by the movement of piston 62 during the compression stroke as indicated by the arrow 108 (the block 60 and piston 62 moving from the position of FIG. 7 to that of FIG. 8).

The combustion chamber in the cylinder within cylinder block 56 has already compressed during its compression stroke 108 (FIG. 7), and will explosively expand upon fuel injection through line 85 and injector 87 to assume the position shown in FIG. 8 during the power stroke indicated by arrow 114. The fuel injector 87 is timed by the action of cams 132, 138 on lever 89'. The cams 132 and 138 engage lever 89' to rod 89. Rod 89 drives a valve in injector 87 (FIG. 4) to force fuel under pressure in line 85' through an injection nozzle into the chamber 84. Lever 89' is positioned ahead of the exhaust valve levers 47 in the cam cycle.

Alternatively, the air and fuel mixture within the combustion chamber and cylinder block 60 may be ignited and combusted by spark plug-type ignition methods well-known to those skilled in the art, the intake valves having been closed by movement of the cam plates, if desired. The cylinder block 56 will thus be propelled in the direction indicated by arrow 100. The piston 62 will then be propelled in the direction indicated by arrow 106 until it reaches a fully retracted position (FIG. 8) at the end of its compression stroke indicated by arrow 108. Because piston 62 is fixed relative to piston 58 by connecting rod 34, piston 62 will be retracted within cylinder block 60 to compress the air within its combustion chamber during the stroke indicated by arrow 108. Thus, at the end of the 180° movement indicated by arrow 108, the combustion chamber within cylinder block 60 will be prepared for fuel injection in order to contribute its rotary power.

As cylinder block 56 continues in the direction indicated by arrow 112, piston 58 is forced longitudinally as indicated by arrow 116. This portion of the movement of cylinder block 56 is referred to as the exhaust stroke during which the combusted gases are scavenged or exhausted through the valves and housing 14 in the exhaust stroke indicated by arrow 118. Simultaneously, piston 62 moves explosively in the direction 117 during its power stroke 114.

As the rotor assembly continues to rotate about axis 48, the combustion chamber within cylinder block 56 will then be expanded in its own intake stroke to receive air for successive compression, power and exhaust strokes. During its intake stroke, the valves are opened by the cam plates as explained.

In such a manner, in two complete 360° rotations of the rotor assembly about axis 48, each cylinder block 56, 60 contributes power in a power stroke to the rotor assembly. Both power strokes are accomplished in the same revolution of the rotor assembly, while the second revolution of the rotor assembly may be termed a dead or driven revolution.

Summarizing, in the schematic of FIG. 7, piston 62 is just commencing its compression stroke and piston 58 is just commencing its power stroke, the valves on both the intake and exhaust side being closed. The intake valves should have just been closed. At the end of the 180° rotation of the rotor assembly (FIG. 8), piston 62 will begin its power stroke and piston 58 will begin its exhaust stroke, the exhaust valves being opened during the second 180° movement. During the third 180° movement, piston 62 will begin its exhaust stroke and piston 58 will begin its intake stroke, all of the valves being opened during this stroke. During the fourth 180° movement, piston 58 will begin its compression stroke, the exhaust valves being closed, and piston 62 will begin its intake stroke. The intake valves will remain open during this fourth 180° movement.

Figure 9:
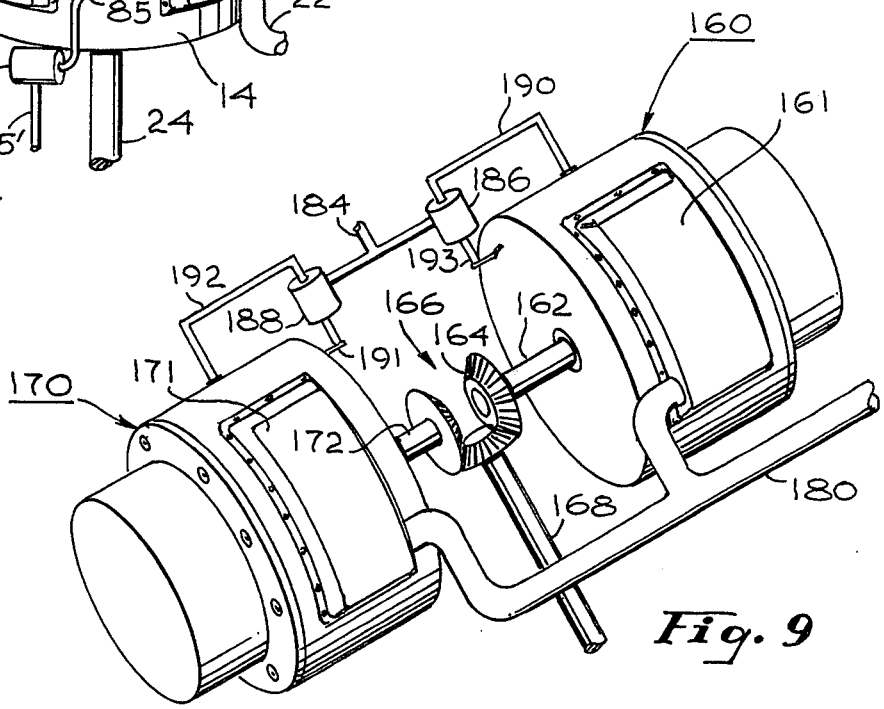
FIG. 9 is a perspective view showing an alternative mode of operation embodying the invention.

It is contemplated that a plurality of such rotary ICEs can be arranged so that their rotary shaft power can be cumulatively added to a single drive shaft. In FIG. 9 is shown one such arrangement, where a rotary ICE 160 constructed according to the present invention is arranged oppositely from rotary ICE 170. Motor shaft 162 of ICE 160 ends in a differential wheel 164 of differential 166. Drive shaft 168 receives the combined cumulative rotary power of the rotor shaft 162 and rotor shaft 172. Other arrangements may be perceived.

Air is received by the ICEs 160, 170 through corresponding intake manifolds 161, 171 and common intake pipe 180. The fuel is fed through fuel line 184 to corresponding fuel injectors 186, 188 which forcedly inject fuel into the combustion cylinders through corresponding lines 190, 192. The injector 188 is timed by rod 191 actuated by cams, not shown, for ICE 170. Similarly, the injector 186 is timed by rod 193 actuated by cams, not shown, for ICE 160.

Figure 10:
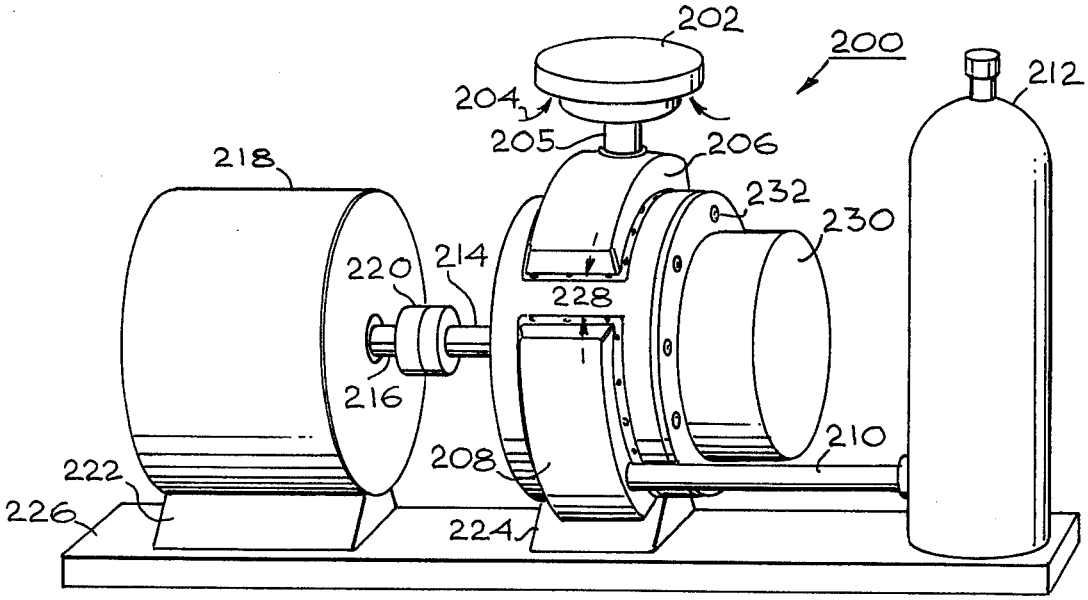
FIG. 10 illustrates a perspective view of an alternative embodiment of the invention used as a compressor.

An alternative embodiment of the invention used as a compressor or as a compressor pump is shown in FIG. 10. A compressor 200 is constructed substantially similar to the construction of internal combustion engine 10, having a rotor assembly comprising two cylinder blocks having reciprocating pistons thereon, a crank rotating about a center distinct from the center of the compressor and constrained by a guideway along a diameter of the interior cylindrical surface. Fluid such as air is received through a filter 202 in the direction of arrows 204. The air is drawn by an expanding cylinder within the compressor 200 through the intake pipe 205 and the intake manifold 206. After compression, the fluid is expelled through the exhaust manifold 208 through conduits 210 to some reservoir 212 for further use.

The rotor assembly of the compressor 200 rotates with the axle 214 driven by the drive shaft 216 of electric motor 218. The axle 214 and motor drive shaft 216 may be connected by coupling 220 as desired. The motor 218 and compressor 200 can be mounted by corresponding mounts 222 and 224 to a floor or mounting plate 226, on which the reservoir also may be positioned.

The compressor 200 may be used to pump liquids or may be used to compress and force gases. If desired, the exhaust manifold 208 may be spaced from the intake manifold 206 in the circumferential distance 228 so as to receive compressed gas at or near the end of the compression stroke of the cylinders. In such a manner, the gas will be compressed in the cylinder for a short distance 228 before it exhausts through the conduit 210 to the reservoir 212.

In acting as a compressor, the unique rotary reciprocating piston arrangement of the invention will operate on a two-stroke cycle, completing a cycle every revolution of the individual cylinders. As with the internal combustion engine 10, a cover 230 is provided connected to the compressor by bolts 232, and is removable for maintenance of the crank and rotor assembly as may be necessary. The reservoir 212 may be connected to various outlets where compressed gas or pumped liquid may be desired. Any means of suitable rotor power may be used to drive axle 214, the electric motor 218 as shown being representative.

Although there have been described above specific arrangements of a rotary ICE in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A rotary internal combustion engine comprising:

a housing including a right circular cylindrical interior surface;

rotor means for providing rotary shaft power including a partially cylindrical exterior and a rotor adapted to rotate concentrically within, and about the axis of, the cylindrical interior surface, the rotor including at least a first cylinder block and a second cylinder block rotatably disposed about an axis of rotation coincident with an axis for the cylindrical interior surface;

cylinder means within each of said cylinder blocks defining a combustion chamber for receiving therein a longitudinally movable piston, a first piston in the first cylinder block and a second piston in the second cylinder block, the cylinder block and both ends of the associated piston being shaped to conform to the housing interior surface;

connecting means for rotatably connecting the first piston, the second piston and a first end of a crank; and link means including the crank, for movably connecting the connecting means and the housing at a point offset from the axis for the cylindrical interior surface.

2. The engine of claim 1 wherein the crank rotates about a second end thereof and about the said connecting point.

3. The engine of claim 1 wherein the pistons are adapted to have both diametrical and centrifugal movement in rotating about the cylindrical interior surface axis.

4. The engine of claim 3 wherein the pistons have a dynamic center of rotation when the crank is moving.

5. The engine of claim 1 wherein the connecting means includes a connecting rod having at least three ends, one end connecting to a piston pin connected to the first piston, a second end connected to a second piston pin connected to the second piston and the third end connected to the crank first end.

6. The engine of claim 5 wherein the connecting means further includes a guideway positioned along a diameter of the cylindrical interior surface and which guideway rotates with the rotor; and, wherein the first crank end is adapted to slide along the guideway.

7. The engine of claim 6 wherein the guideway is a track, and the first crank end is adapted to fit slideably therein.

8. The engine of claim 1 wherein the link means includes a yoke mounted on the housing and having the second end of the crank rotatably connected to a center portion thereof.

9. The engine of claim 8 wherein the crank may be adjustably connected to the center portion.

10. The engine of claim 9 wherein the yoke center portion includes a slot within which a link connecting the crank thereto may be adjustably positioned.

11. The engine of claim 1 further including an output shaft connected to the rotor.

12. The engine of claim 11 further including valves selectively opened to allow air to intake into, and gases to exhaust from the cylinders.

13. The engine of claim 12 including at least a set of air intake valves and a set of gas exhaust valves, said valves adapted to operate by engagement with cams on rotating cam plates.

14. The engine of claim 13 wherein the cam plates are rotated by the output shaft connected thereto by gearing.

15. The engine of claim 14 having a four-stroke cycle operation comprising a stroke for each cylinder for each one-half revolution about the cylindrical interior surface axis.

16. The engine of claim 15 wherein the first cylinder has a compression stroke and a power stroke during one rotor complete revolution about the interior surface axis while the second cylinder during the same rotation about the interior axis has successively a power stroke and an exhaust stroke.

17. The engine of claim 15 wherein the second cylinder has successively an intake stroke and a compression stroke during a revolution about the cylindrical interior surface axis while during the same revolution the first cylinder has successively an exhaust stroke and an intake stroke.

18. The engine of claim 15 wherein both exhaust valves and intake valves are opened during a one-half revolution of the rotor about the cylindrical interior surface axis.

19. The engine of claim 1 wherein the cylinder means includes sleeve means for sealing boundaries of a cylinder to the interior cylindrical surface.

20. The engine of claim 19 wherein the sleeve means includes a cylindrical sleeve mounted within the cylinder and adapted to be urged by centrifugal force against the interior cylindrical surface during rotor rotation.

21. The engine of claim 20 wherein the sleeve means further includes springs biasing the sleeve into engagement with the cylindrical interior surface.

22. The engine of claim 1 further including a second housing, a second rotor means, a second set of cylinder blocks, a second connecting meas, a second link means, and a common output shaft connecting the first said rotor means and the second said rotor means.

23. A compressor comprising:

a first cylinder rotatable about an axis of an interior cylindrical surface, and a first piston adapted to reciprocate within the first cylinder;

a second cylinder symmetrically disposed about the axis from the first cylinder and rotatable about the axis, and a second piston adapted to reciprocate within the second cylinder;

valve means including at least two fluid valves adapted to allow fluid to intake into and egress from the cylinders;

means for rotating the first and second cylinders about the axis, including a guideway disposed along a diameter of the interior cylindrical surface adapted to rotate about the axis with the cylinders; and means for reciprocating the pistons within their corresponding cylinders to sequentially intake fluid into the cylinders and expel the fluids therefrom, said reciprocating means including means connected to the pistons and reciprocating within the guideway during rotation.

24. The compressor of claim 23 wherein the means connected to the piston includes a crank adapted to rotate about an axis distinct from the axis of the interior cylindrical surface.

* * * * *